United States Patent [19]

Sugimoto et al.

[11] 4,165,129

[45] Aug. 21, 1979

[54] SHIELD TUNNELING MACHINE AND METHOD

[75] Inventors: Yoshihito Sugimoto, Kokubunji; Konosuke Miyata, Matsudo; Kanehiro Ishihara, Tokyo; Sachio Fujimoto, Yachiyo; Tsunehiro Kakutani, Kashiwa, all of Japan

[73] Assignees: Ishikawajima-Harima Jukogyo Kabushiki Kaisha, Tokyo; Sato Kogyo Kabushiki Kaisha, Toyama, both of Japan

[21] Appl. No.: 852,308

[22] Filed: Nov. 17, 1977

[51] Int. Cl.[2] ..... E21D 9/08

[52] U.S. Cl. ..... 299/11; 299/31; 299/56; 405/141

[58] Field of Search ..... 61/85, 84; 299/31, 33, 299/56, 1

[56] References Cited

U.S. PATENT DOCUMENTS

| | | | |
|---|---|---|---|
| 1,530,768 | 3/1925 | Haag | 61/85 |
| 3,260,054 | 7/1966 | Lorenz | 61/85 |
| 3,334,945 | 8/1967 | Bartlett | 61/85 |
| 3,561,223 | 2/1971 | Tabor | 299/33 |
| 4,040,666 | 8/1977 | Uchida | 61/84 |
| 4,068,486 | 1/1978 | Uchida | 61/85 |
| 4,116,487 | 9/1978 | Yamazaki et al. | 299/1 |

FOREIGN PATENT DOCUMENTS

| | | | |
|---|---|---|---|
| 84525 | 12/1895 | Fed. Rep. of Germany | 299/5 C |
| 2745928 | 4/1978 | Fed. Rep. of Germany | 299/1 |

*Primary Examiner*—William Pate, III

*Attorney, Agent, or Firm*—Scrivener, Parker, Scrivener & Clarke

[57] ABSTRACT

Shield tunneling machine and method which may minimize the variation in water- and earth-pressure at the tunneling face so as to hold the ground firm and to ensure the safe tunneling.

11 Claims, 3 Drawing Figures

SHIELD TUNNELING MACHINE AND METHOD

DETAILED DESCRIPTION OF THE INVENTION

The present invention relates to a shield tunneling machine and a shield tunneling method.

In FIG. 1 there is shown a prior art pressed muddy water shield tunneling method wherein the bentonite solution is pumped through a bentonite supply pipe 52 into a space behind a cutter 51 within a shield frame 50 in order to hold the tunneling face 53 firm and the muck or spoil is agitated by an agitator 54 and discharged through a discharge pipe 55.

The above prior art method has the following problems:

(1) Since the stresses of the face 53 are relieved immediately, the muck or spoil flows through the cutter slits, causing the collapse of the face 53 when the tunnel is driven through the sandy layer or the gravelly layer.

(II) The face 53 is disturbed by the cutter 51 and cannot be stabilized by the application of the bentonite coatings.

(III) When the sandy or gravelly layer is tunneled through, the concentration of the bentonite solution must be increased. As a result the treatment of muddy water is difficult and requires a large facility. Furthermore a chemical agent must be added for facilitating the sedimentation of mud and sand.

(IV) Once an uncontrolled flow of material into the tunnel happens, it cannot be prevented.

(V) With a high pressure of bentonite solution, the displacement of groundwater results so that the surrounding ground is loosened.

(VI) The pressure of the bentonite solution is generally the ground water pressure at the face plus 0.2 $kg/cm^2$ so that when the depth of tunnel is shallow, there is a fear that the water gushes above the ground.

(VII) Because of the problems (I), (IV), (V) and (VI) the settlement and displacement of the ground occurs, endangering the tunneling operation.

(VIII) The bentonite solution is supplied in order to stabilize the face and to discharge the muck. In order to stabilize the face, the bentonite solution is preferred high in concentration, but in order to discharge the muck the bentonite solution low in concentration is preferred. That is, there exists an antinomy. Thus it is extremely difficult to select the concentration which is satisfactory both for stabilizing the face and for facilitating the discharge of the muck.

In view of the above, the primary object of the present invention is to solve the above and other problems encountered in the prior art shield tunneling methods and machines, thereby preventing the settlement and displacement of the ground and ensuring the safe tunneling operation.

Another object of the present invention is to eliminate the hazards caused by the compressed air shield which has come to be used widely.

A further object of the present invention is to eliminate the pollution problem caused by the treatment of the muddy water with agents.

A further object of the present invention is to provide an automatic muck discharge method and device.

The present invention will become more apparent from the following description of preferred embodiments thereof taken in conjunction with the accompanying drawings, in which.

Figure 1:
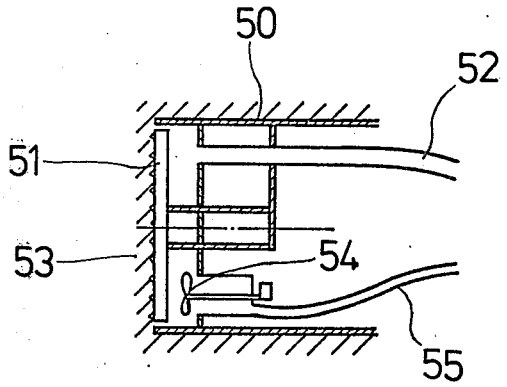
PRIOR ART Fig. 1
FIG. 1 is a schematic view used for the explanation of a prior art shield tunneling method.
Figure 2:
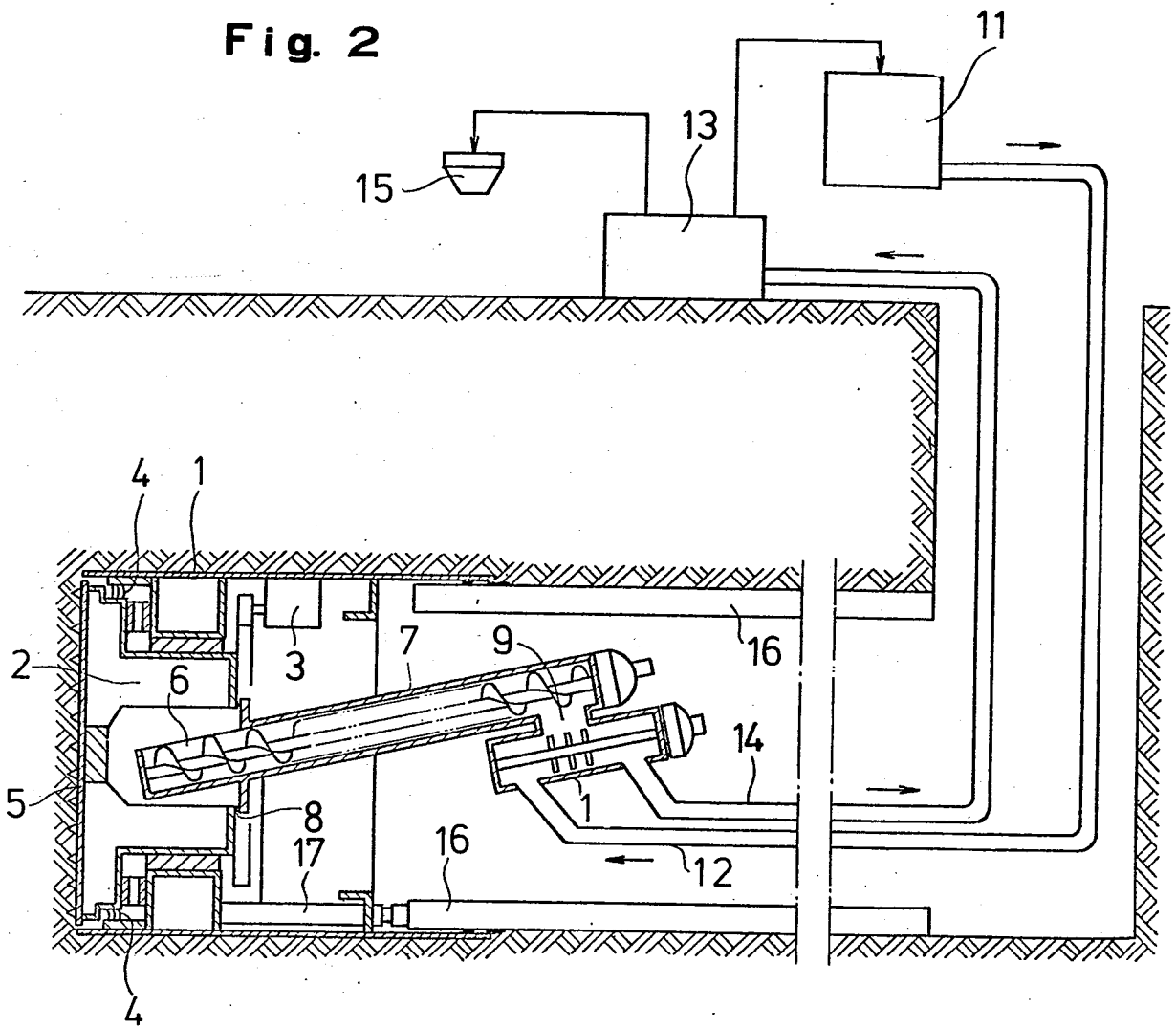
FIG. 2 is a schematic sectional view of a shield tunneling machine in accordance with the present invention.

Referring to FIG. 2, a cutter 5 with a cutter chamber 2 is disposed at the front end of a shield frame 1 and is driven by cutter drive motors 3. Sealing members 4 are sealingly disposed between the periphery of the cutter 5 and the front edge of the shield frame 1.

The front end portion with a loading opening 6 of a screw conveyor 7 is placed in the cutter chamber 2 and is sealed with sealing members 8 in such a way that even when the cutter 5 is driven, the water-tightness of the cutter chamber 2 may be maintained.

A mucking adjustor 10 such as an agitator for controlling the concentration of the muddy water is disposed immediately below an unloading opening 9 at the rear end of the screw conveyor 7 and is communicated through a water supply pipe 12 with a water tank 11 and through a discharge pipe 14 with a muck-water separator 13. The muck or mud separated by the separator 13 is transported into a hopper 15 which in turn transports the separated muck or mud to a suitable disposal site. The water separated by the muck-water separator 13 is returned to the water tank 11 for recirculation.

The driven tunnel is supported by segments 16, and shield jacks 17 are disposed at the front edges of the segments 16 for jacking the cutter 5 forward.

As described above, the cutter chamber 2 is maintained water-tight and the sealing members 4 maintains the water-tightness between the periphery of the cutter 5 and the shield frame 1. The muck which is cut by the cutter 5 from the face fills not only the cutter chamber 2 but also the screw conveyor 7 through the loading opening 6 so that an uncontrolled flow of the muck from the face to the cutter chamber 2 may be prevented and the stresses of the face are not relieved. The muck in the cutter chamber 2 is transported by the screw conveyor in a controlled quantity and is discharged through the unloading opening 9 into the mucking adjustor 10.

The muck in the mucking adjuster 10 is agitated with the water charged through the water supply pipe 12 and is discharged through the discharge pipe 14 to the ground surface. The uncontrolled flow of water from the face into the cutter chamber 2 can be prevented by maintaining the pressure of water charged into the mucking adjustor 10 same with the ground water pressure at the face. Even if the pressure of water charged into the mucking adjustor is changed, the fluctuating pressure is not transmitted to the face by the muck filled in the screw conveyor so that the face is maintained at a stable condition.

The muck and water mixture is discharged through the discharge pipe 14 into the muck-water separator 13, and the separated muck is charged into the hopper 15 while the separated water is returned to the water tank 11 for recirculation as described hereinbefore.

It is essential to maintain a predetermined relationship between the driving speed of the cutter 5 which is advanced by the shield jacks 17 and the muck transporting speed of the screw conveyor 7. The mucking adjustor 10 crushes the muck in the form of a lump and mixes and agitates the crushed muck with the water so that the muck discharge may be facilitated. Therefore when the muck is relatively finely divided, a mucking adjustor which consists of a simple chamber with a screen in which the muck is agitated only by the water flow charged through the pipe 12 without the agitator, may be used.

Figure 3:
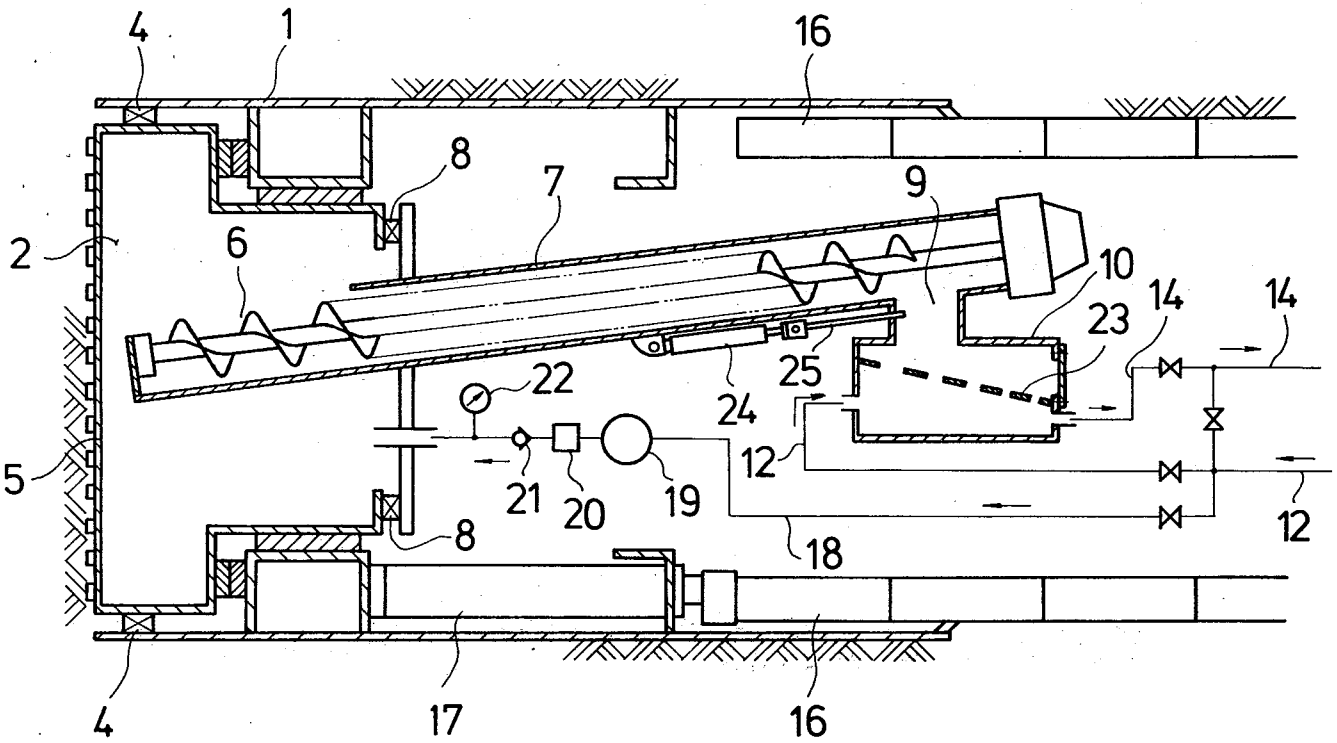
FIG. 3 is a sectional view of another embodiment of the present invention.

Next referring to FIG. 3, another embodiment of the present invention will be described. In FIG. 3, same reference numerals as used in FIG. 2 are also used to designate similar parts. The second embodiment of the present invention shown in FIG. 3 is substantially similar in construction to the first embodiment shown in FIG. 2 so that only the difference in construction between them will be described. A branch pipe 18 including a pump 19, a flow meter 20, a nonreturn valve 21 and a pressure gage 22 is branched from the water supply pipe 12 and is communicated with the cutter chamber 2 so that the water under a controlled pressure may be charged therein. The above-mentioned water pressure control is a pore water pressure control in the face and the cutter, and it is separated completely from the muck discharge. Therefore the very fine yet very simple control of the pressures both in the cutter chamber 2 and at the tunneling face may be effected. In the second embodiment, the mucking adjustor 10 includes a screen 23, and a gate 25 is provided which is actuated by a hydraulic cylinder 24 for controlling the degree of opening of the unloading opening 9 of the screw conveyor 7. The screen 23 is provided so as to remove the muck in the form of a lump which the muck discharge is not facilitated and to divide the clayey muck finely. The finely divided muck is discharged after agitating and mixing by the water flow charged through the pipe.

Since the branch pipe 18 is provided, the pressure within the cutter chamber 2 may be freely controlled so that the tunneling face may be securely stabilized. Since the degree of opening of the unloading opening 9 of the screw conveyor 7 is controlled by the gate 25, the pressure within the cutter chamber 2 may be couble controlled. More particularly, the gate 25 permits the coarse control of the pressure within the cutter chamber 2 within a wide range while the charging of the water under a controlled pressure through the branch pipe 18 into the cutter chamber 2 permits the fine control of the pressure therein. Thus the pressure within the cutter chamber 2 may be optimumly controlled.

So far the present invention has been described with reference to two preferred embodiments thereof, but it will be understood that various modifications may be effected without departing the true spirit of the present invention.

What is claimed is:

1. A shield tunneling machine comprising
(a) a cutter disposed for rotation by motors, maintained in water-tight relationship with the inner surface of a shield frame with sealing members and formed integral with a water-tight cutter chamber,
(b) a screw conveyor water-tightly connected to said cutter chamber in such a way that the loading opening of said screw conveyor is communicated with said cutter chamber, and
(c) a mucking adjuster for the mixture of muck and water disposed immediately below the unloading opening of said screw conveyor and connected at one end thereof with a water supply pipe and at the other end thereof with a discharge pipe.

2. A shield tunneling machine as set forth in claim 1 wherein said mucking adjuster is an agitator.

3. A shield tunneling machine as set forth in claim 1 further comprising a gate for controlling the degree of opening of said unloading opening of said screw conveyor.

4. A shield tunneling machine comprising
(a) a cutter disposed for rotation by a motor, maintained in water-tight relationship with the inner surface of a shield frame with sealing members and formed integral with a water-tight cutter chamber,
(b) a screw conveyor water-tightly connected to said cutter chamber in such a way that the loading opening of said screw conveyor is communicated with said cutter chamber,
(c) a mucking adjustor for the mixture of muck and water disposed immediately below the unloading opening of said screw conveyor and connected at one end thereof with a water supply pipe and at the other end thereof with a discharge pipe, and
(d) a branch pipe branched from said water supply pipe for charging the water into said cutter chamber.

5. A shield tunneling machine as set forth in claim 4 wherein said branch pipe includes a pump, a flow meter, a nonreturn valve and a pressure gage for charging into said cutter chamber the water under a controlled pressure.

6. A shield tunneling machine as set forth in claim 4 further comprising a gate for controlling the degree of opening of said unloading opening of said screw conveyor.

7. A shield tunneling machine as set forth in claim 4 wherein a screen is provided within said mucking adjuster.

8. A shield tunneling method comprising the steps of
(a) maintaining water-tight a space behind a rotatable cutter while the muck fills said space,
(b) transporting the muck through a screw conveyor out of said space in a water-tight manner, and
(c) mixing the muck discharged from said screw conveyor with the water and discharging the mixture of the muck and the water.

9. A shield tunneling method as set forth in claim 8 wherein the driving speed of said screw conveyor is selected depending upon the driving speed of said cutter in such a way that said water-tight transport of the mud through said screw conveyor may be permitted.

10. A shield tunneling method comprising
(a) maintaining water-tight a space behind a cutter while the muck fills said space,
(b) transporting the muck through a screw conveyor out of said space in a water-tight manner,
(c) mixing the muck discharged from said screw conveyor with the water and discharging the mixture of the muck and the water, and
(d) charging the water into said water-tight space behind said cutter so as to control the pressure at the tunneling face.

11. A shield tunneling method as set forth in claim 10 wherein the driving speed of said screw conveyor is selected depending upon the driving speed of said cutter in such a way that said water-tight transport of the mud through said screw conveyor may be permitted.

* * * * *